US007868864B2

(12) United States Patent
Hsieh

(10) Patent No.: US 7,868,864 B2
(45) Date of Patent: Jan. 11, 2011

(54) GRAY-SCALE CIRCUIT

(75) Inventor: Ming-Cheng Hsieh, Tainan (TW)

(73) Assignee: Chimei Innolux Corporation (TW)

( * ) Notice: Subject to any disclaimer, the term of this patent is extended or adjusted under 35 U.S.C. 154(b) by 814 days.

(21) Appl. No.: 11/799,811

(22) Filed: May 2, 2007

(65) Prior Publication Data

US 2007/0257875 A1 Nov. 8, 2007

(30) Foreign Application Priority Data

May 2, 2006 (TW) ..... 95115640 A

(51) Int. Cl.
*G09G 3/36* (2006.01)

(52) U.S. Cl. ..... 345/89; 345/87

(58) Field of Classification Search ..... 345/87–102, 345/204, 214

See application file for complete search history.

(56) References Cited

U.S. PATENT DOCUMENTS 5,774,101 A * 6/1998 Hirai et al. ..... 345/89
5,796,379 A * 8/1998 Enomoto et al. ..... 345/89
5,953,002 A * 9/1999 Hirai et al. ..... 345/204
6,801,178 B2 * 10/2004 Nitta et al. ..... 345/89
6,924,824 B2 * 8/2005 Adachi et al. ..... 345/690
7,006,069 B2 * 2/2006 Tanaka et al. ..... 345/98
7,023,458 B2 * 4/2006 Kudo et al. ..... 345/690
7,038,651 B2 * 5/2006 Nitta et al. ..... 345/98
7,084,845 B2 * 8/2006 Hong ..... 345/89
RE39,366 E * 10/2006 Nitta et al. ..... 345/98
7,352,350 B2 * 4/2008 Nitta et al. ..... 345/94
7,505,017 B1 * 3/2009 Yeo et al. ..... 345/88
RE40,916 E * 9/2009 Nitta et al. ..... 345/98
2005/0212740 A1 * 9/2005 Miyagawa ..... 345/89
2006/0176261 A1 * 8/2006 Nitta et al. ..... 345/94
2007/0070010 A1 * 3/2007 Oohira ..... 345/89
2008/0259018 A1 * 10/2008 Kasai ..... 345/96
2010/0066728 A1 * 3/2010 Oohira ..... 345/214

FOREIGN PATENT DOCUMENTS

CN 1920926 2/2007

* cited by examiner

*Primary Examiner*—Nitin Patel
(74) *Attorney, Agent, or Firm*—Trop Pruner & Hu, P.C.

(57) ABSTRACT

A gray-scale circuit may receive pixel data to generate first set of gray-scale voltages that enable a display show the different gray-scale levels of normal images during a first time period. The gray-scale circuit may generate a second set of gray-scale voltages to enable the display show a common gray-scale level during a second time period.

19 Claims, 6 Drawing Sheets

GRAY-SCALE CIRCUIT

CROSS REFERENCE TO RELATED APPLICATION

This claims priority under 35 U.S.C. §119 of Taiwan Application No. 095115640, filed May 2, 2006.

TECHNICAL FIELD

This invention relates generally to a gray-scale circuit, and more particularly to a gray-scale circuit in a plane display.

BACKGROUND

Flat panel displays have been widely applied in electrical products due to the rapid progress of optical and semiconductor technologies. Liquid crystal displays (LCD), especially thin film transistor (TFT) LCDs, are becoming the mainstream display apparatus having been introduced into portable computers, mobile phones, personal digital assistants, and color televisions. The popularity of LCDs may be due, at least in part, to their high image quality, compact size, light weight, low driving voltage, low power consumption, and various applications.

In principle, TFT LCDs work by applying a proper gray-scale voltage to the pixels on the LCD panel. This changes the angles of liquid crystal molecules and the light transmittance of the panel to achieve the gray-scale levels needed to display. However, since LCDs are hold-type displays, which is different from conventional CRT displays as impulse-type displays, blurring occurs when motion images are displayed in hold type. At present, the conventional solution to blurring is to switch the back-light module on and off, or to insert a black image signal. Nevertheless, continuously switching the back light module on and off increases the power consumption of the back light module and an additional control signal is necessary for the system needs to send the black image signal, which increases the complexity of the design of the system.

Furthermore, when an LCD is turned on, correct data signals, such as low voltage differential signals (LVDS), have not been sent to the data driver yet. But there is residual data voltage left in the data driver due to the earlier display or other reason, which is referred to as the initial state, and the data driver outputs the residual data voltage. Moreover, different driving ICs in the data driver send out different signals based on their distinct initial states. Thus, band mura is still shown indistinctly on the display even though the lights are not yet turned on. Thus, there is a continuing need for flat panel displays that improves blurring with motion images and decreases band mura.

DETAILED DESCRIPTION

Figure 6:
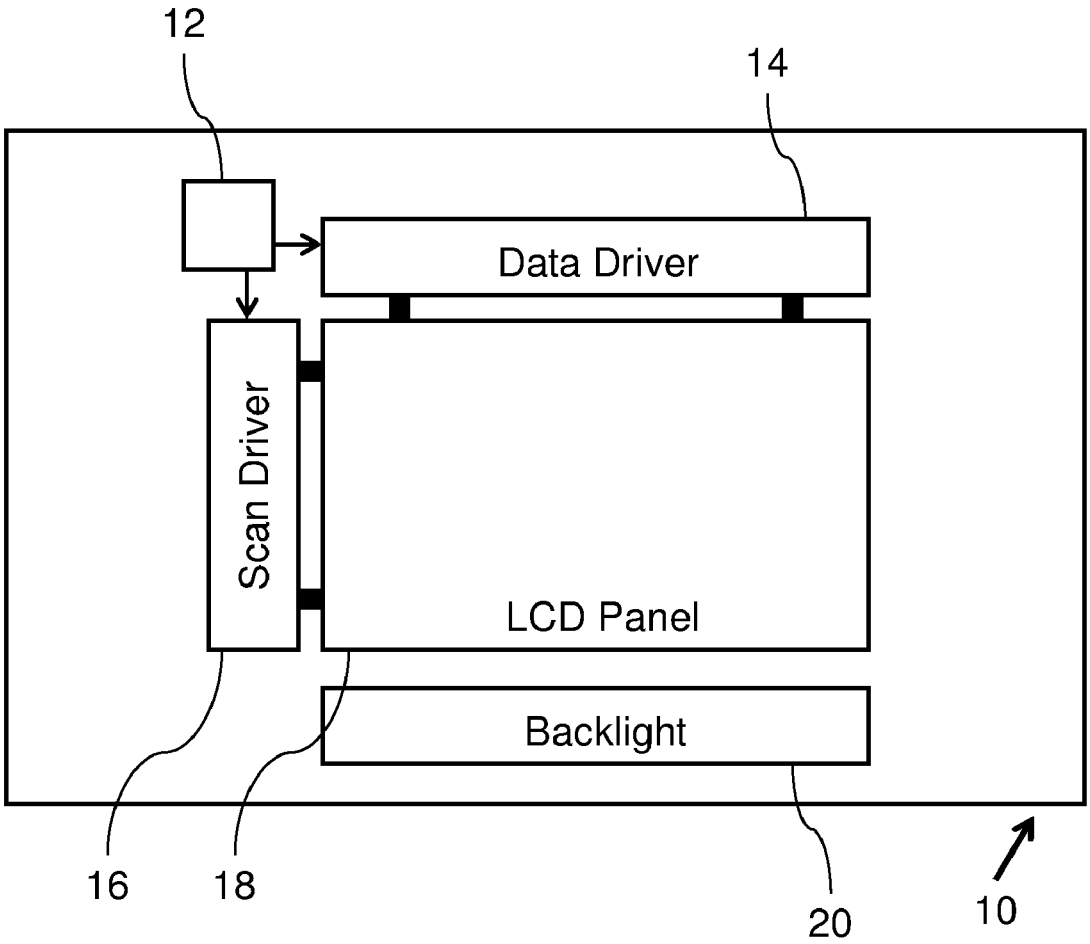
FIG. 6 is a block diagram of a display apparatus according to an embodiment.

Referring to FIG. 6, in some embodiments of the present invention, a display apparatus 10 may include a control circuit 12, a data line driver 14, a scan line driver 16, a liquid crystal display (LCD) panel 18, and a light module 20. The light module 20 may be a backlight module, but embodiments are not limited to this example. Furthermore, the LCD panel 18 may be a thin film transistor (TFT) LCD panel, without limitation. Generally, the control circuit 12 supplies control and data signals to the data 14 and scan 16 line drivers. In some embodiments, the data line driver 14 may also receive digital video data signals, reference voltages, and/or polarity signals (POL). If the LCD panel 18 is a TFT LCD panel, the scan line drivers 16 switch the TFTs on and off in response to a signal from the control circuit. Additionally, the data line drivers 14 convert digital video data signals to analog signals and supply the converted signals to data lines connected to the TFT of each pixel. The analog signals may be representative of the intended gray-scale to be displayed on the LCD panel 18.

According to some embodiments of the present invention, at least a portion of a gray-scale circuit may be set in the data line driver 14. The gray-scale circuit may output first gray-scale voltages at a first time for a plurality of gray-scale levels (for normal images) and second gray-scale voltages at a second time for a common gray-scale level (such as black). To enable the output of the different sets of voltages, the gray-scale circuit may include switches to switch between analog voltage outputs for a normal image and voltage output for an image of a common gray-scale level. That is, the output to the display panel 18 may be controlled by a control signal that turns on and off switches so that a normal image or a common gray-scale image (e.g. black) is displayed. The black image can be shown between normal images to decrease the blurring of motion images, or before the initial of the system to make the display show uniform black images when activating the display in order to eliminate the band mura. Furthermore, because the switches of embodiments of the gray-scale circuit are set directly in the data driver 14, the gray-scale circuit may be made directly in the process of forming the data driver 14, which saves in the cost of forming the components, and embodiments of the gray-scale circuit are easier to operate in high frequency.

Figure 1:
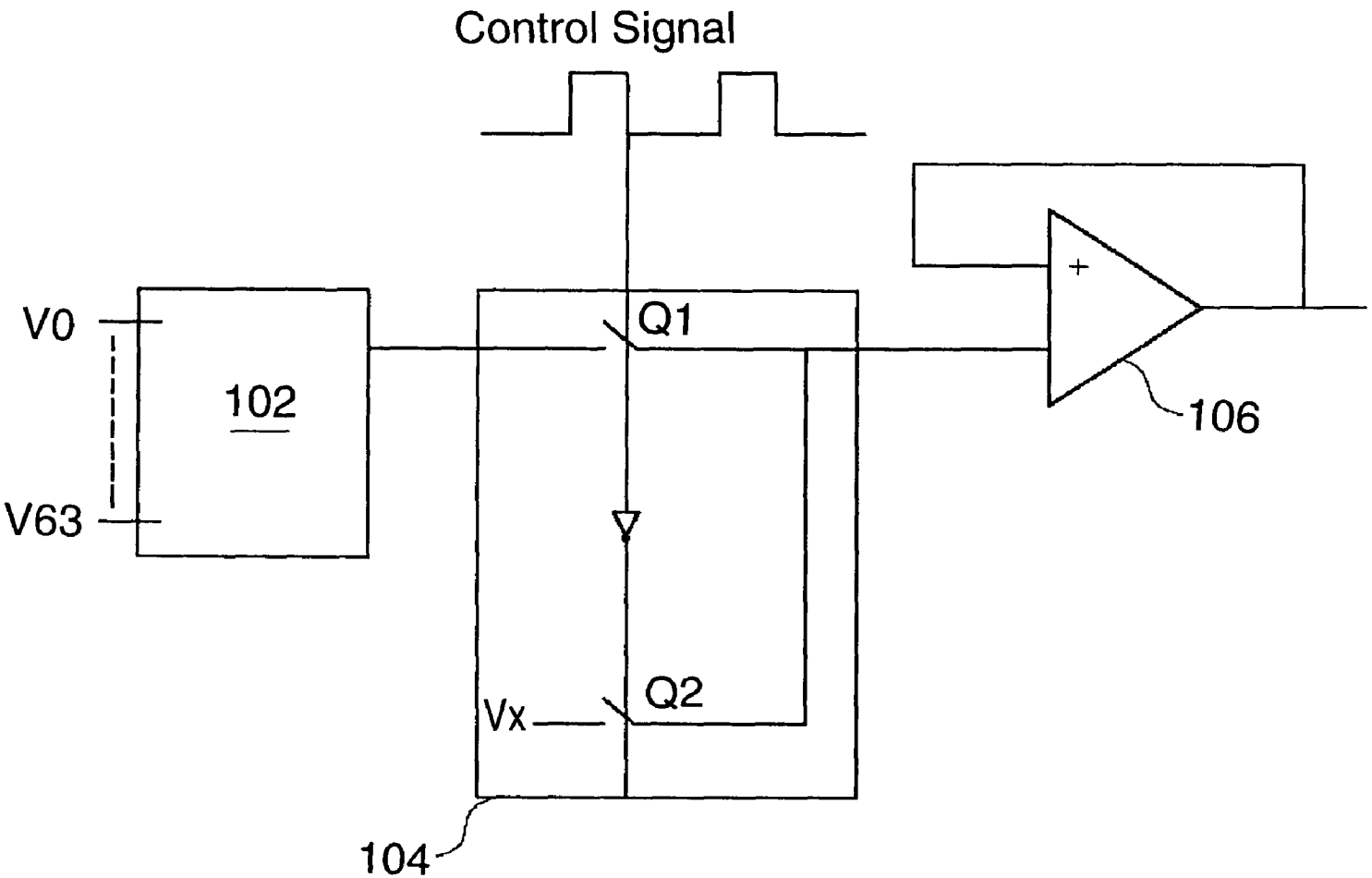
FIG. 1 is a diagram of a gray-scale circuit according to an embodiment.

One embodiment of a gray-scale circuit is shown in FIG. 1. This gray-scale circuit may be located in the data driver 14 and it may include a digital-to-analog converter 102, a switching circuit 104, and an output buffer 106. The switching circuit 104 may include switches Q1 and Q2 that are complementary in phase. In other words, when the switch Q1 is turned on, the switch Q2 is turned off, and when switch Q1 is turned off, the switch Q2 is turned on—the switches Q1 and Q2 are not on at the same time. The switches Q1 and Q2 may be NMOS transistors, PMOS transistors, or any other components that may be used as switches.

The switching circuit 104 may also include an input $V_X$. Any reference voltage such as gray-scale voltages GMA 1 or GMA 10, or $V_{COM}$, etc. can be input via the input $V_X$. In some embodiments, the gray-scale circuit of FIG. 1 includes a selector (not shown) that is electrically connected to the input $V_X$ to choose an input voltage from a plurality of reference voltage sources such as GMA 1, GMA 10, $V_{COM}$, or any other voltage. The input $V_X$ is electrically connected to the switch Q2, and the digital-to-analog converter 102 is electrically connected to Q1.

Generally, the gray-scale circuit of FIG. 1 outputs either a plurality of gray-scale voltages representative of the gray-scale levels of a normal image or a gray-scale voltage representative of a common gray-scale level such as a black image. The on/off state of the switches Q1 and Q2 controls which gray-scale voltages are output. Namely, a control signal from a control circuit (not shown) controls the on/off state of the switches Q1 and Q2 such that when the control signal is high logic, switch Q1 is turned on and switch Q2 is turned off and when the control circuit is low logic, switch Q1 is off and switch Q2 is turned on.

In operation, pixel data may be received by the data line driver 14 to generate the plurality of gray-scale voltages, such as gray-scale voltages V0 to V63. The digital-to-analog converter 102 transmits a first set of analog gray-scale voltages to the switching circuit 104. If the control signal is high logic, the switch Q1 is turned on and the switch Q2 is turned off so that the analog gray-scale voltages may be output through the output buffer 106 to display a normal image. That is, the LCD display panel 18 will show a plurality of different gray-scale levels indicative of a normal image. If the control signal is low logic however, the switch Q1 is turned off and the switch Q2 is turned on, and the reference voltage value of the input $V_X$ (e.g. GMA 1, GMA 10, $V_{COM}$, etc.) is output by the output buffer 106 to make the display show a common gray-scale level, such as a black image on the display. For example, if the voltage value inputted to the input $V_X$ is $V_{COM}$, the output buffer 106 outputs the $V_{COM}$ voltage, although embodiments are not so limited; other values may be inputted into the input $V_X$ according to demands to make the display.

Figure 2:
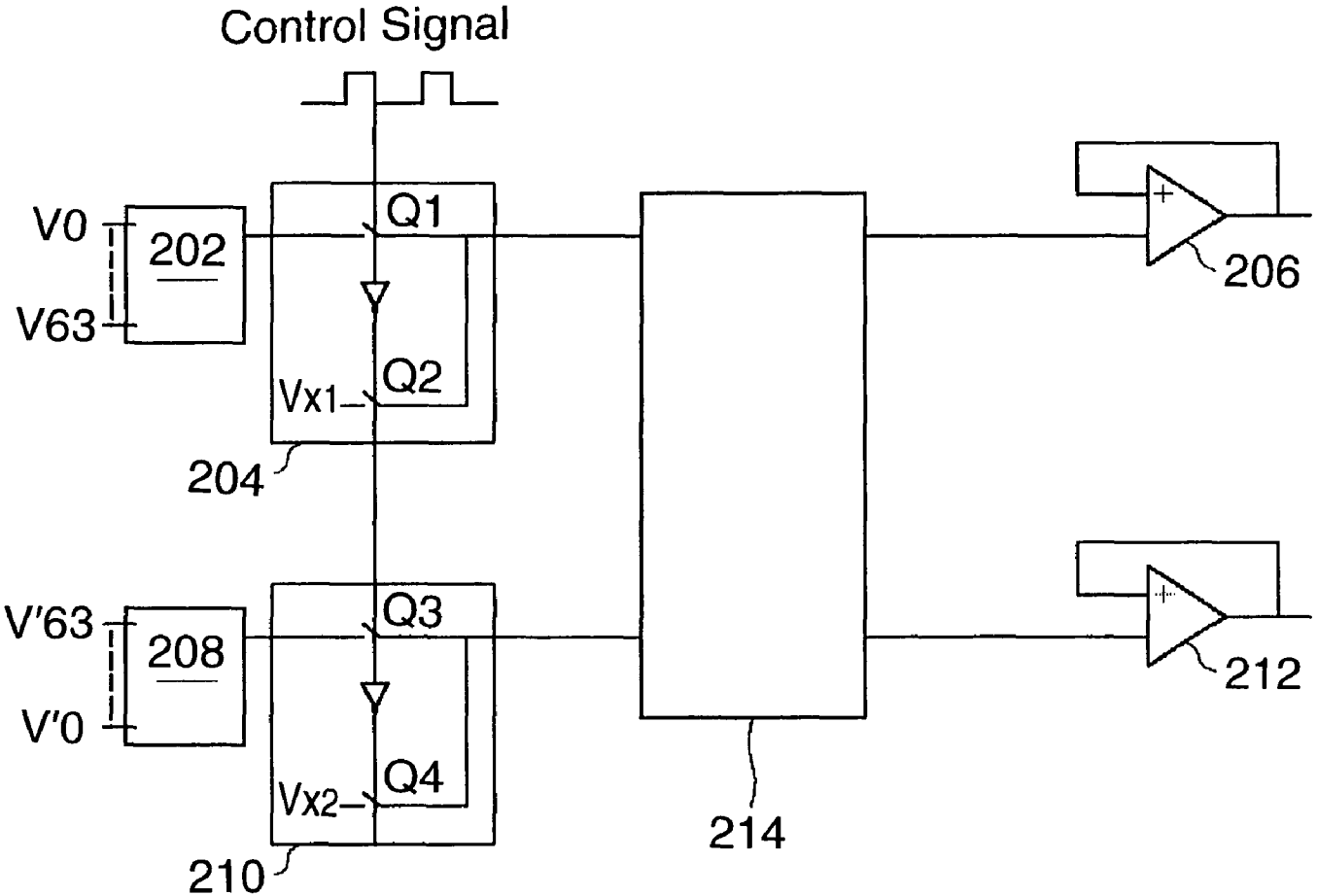
FIG. 2 is a diagram of a gray-scale circuit according to another embodiment.

Another embodiment of a gray-scale circuit is illustrated in FIG. 2. This gray-scale circuit is especially suitable for twisted nematic (TN) displays, although embodiments are not so limited. The gray-scale circuit illustrated in FIG. 2 is similar to that of FIG. 1 in that it is located in the data driver. Furthermore, it includes a (first) digital-to-analog converter 202, a (first) switching circuit 204 having two switches Q1 and Q2 (that are complementary in phase) and a (first) input $V_{X1}$, and a (first) output buffer 206. But the gray-scale circuit of FIG. 2 also includes a second digital-to-analog converter 208, a second switching circuit 210, a second output buffer 212, and a multiplexer (MUX) 214. The second switching circuit 210 includes two switches Q3 and Q4, and a second input $V_{X2}$. Like switches Q1 and Q2, switches Q3 and Q4 are complementary in phase. The switches Q1 to Q4 may be NMOS transistors, PMOS transistors, or any other component that can be used as a switch.

Generally, the gray-scale circuit of FIG. 2 controls the turning off and on of the switches Q1, Q2, Q3, and Q4 according to a control signal. A timing controller circuit (not shown) may generate the control signal. When the control logic is high, switches Q1 and Q3 are turned on and switches Q2 and Q4 are turned off, whereas when the control logic is low, switches Q1 and Q3 are turned off, and switches Q2 and Q4 are turned on. Thus, when the control logic is high, the first output buffer 206 and the second output buffer 212 may output analog gray-scale voltages that were transmitted by the digital-to-analog converters 202 and 208. Alternatively, when the control logic is low, the output buffers 206 and 212 may output the voltage values of the first reference input $V_{X1}$ and the second reference input $V_{X2}$ respectively. In this way, the LCD display panel 18 is able to show normal images or a common gray-scale level such as black images.

In TN displays, when the control logic is high, switches Q1 and Q3 are turned on and switches Q2 and Q4 are turned off. Thus, a first set of analog gray-scale voltages that are based on voltages V0 to V63 are transmitted by the first digital-to-analog converter 202 via the multiplexer 214 to be output by the first output buffer 206. Likewise, a second set of analog gray-scale voltages based on voltages V'0 to V'63 are transmitted by the second digital-to-analog converter 208 via the multiplexer 214 to be output by the output buffer 212. Thus, the display shows a plurality of different gray-scale levels—that is the display shows normal images. When the control signal logic is low however, the switches Q1 and Q3 are turned off and the switches Q2 and Q4 are turned on. In one embodiment, a voltage value input into the first input $V_{X1}$ is GMA 1 and the voltage value input into the second input $V_{X2}$ is GMA 10. Thus, the first output buffer 206 outputs the GMA 1 voltage via the multiplexer 214 and the second output buffer 212 outputs the GMA 10 voltage via the multiplexer 214 to make the display show a common gray-scale level such as a black image.

Because liquid crystal molecules in TN displays need to be periodically inversed, the multiplexer, under the influence of a polarity signal (POL) can be used to change the polarity of the signals transmitted to the first output buffer 206 and the second output buffer 212. Generally, the positive-polarity signal and the negative-polarity signal are outputted from the first output buffer 206 and the second output buffer 212 alternatively to invert the liquid crystal molecules periodically. For example, if the POL logic is high, and if the first set of analog gray-scale voltages are positive-polarity gray-scale voltages and the second set of analog gray-scale voltages are negative-polarity gray-scale voltages, the first output buffer 206 outputs the first set of gray-scale voltages (positive polarity) and the second output buffer 212 outputs the second set of gray-scale voltages (negative polarity). But when the POL logic is low, the first output buffer 206 outputs the second set of gray-scale voltages (negative polarity) and the second output buffer 212 outputs the first set of gray-scale voltages (positive polarity). Alternatively, when the POL logic is high and GMA 1 and GMA 10 are input via inputs $V_{X1}$ and $V_{X2}$ respectively, the first output buffer 206 outputs GMA 1 voltage and the second output buffer 212 outputs GMA 10 voltage, but when the POL control signal is logic low, the first output buffer 206 outputs GMA 10 voltage and the second output buffer 212 outputs GMA 1 voltage.

Figure 3:
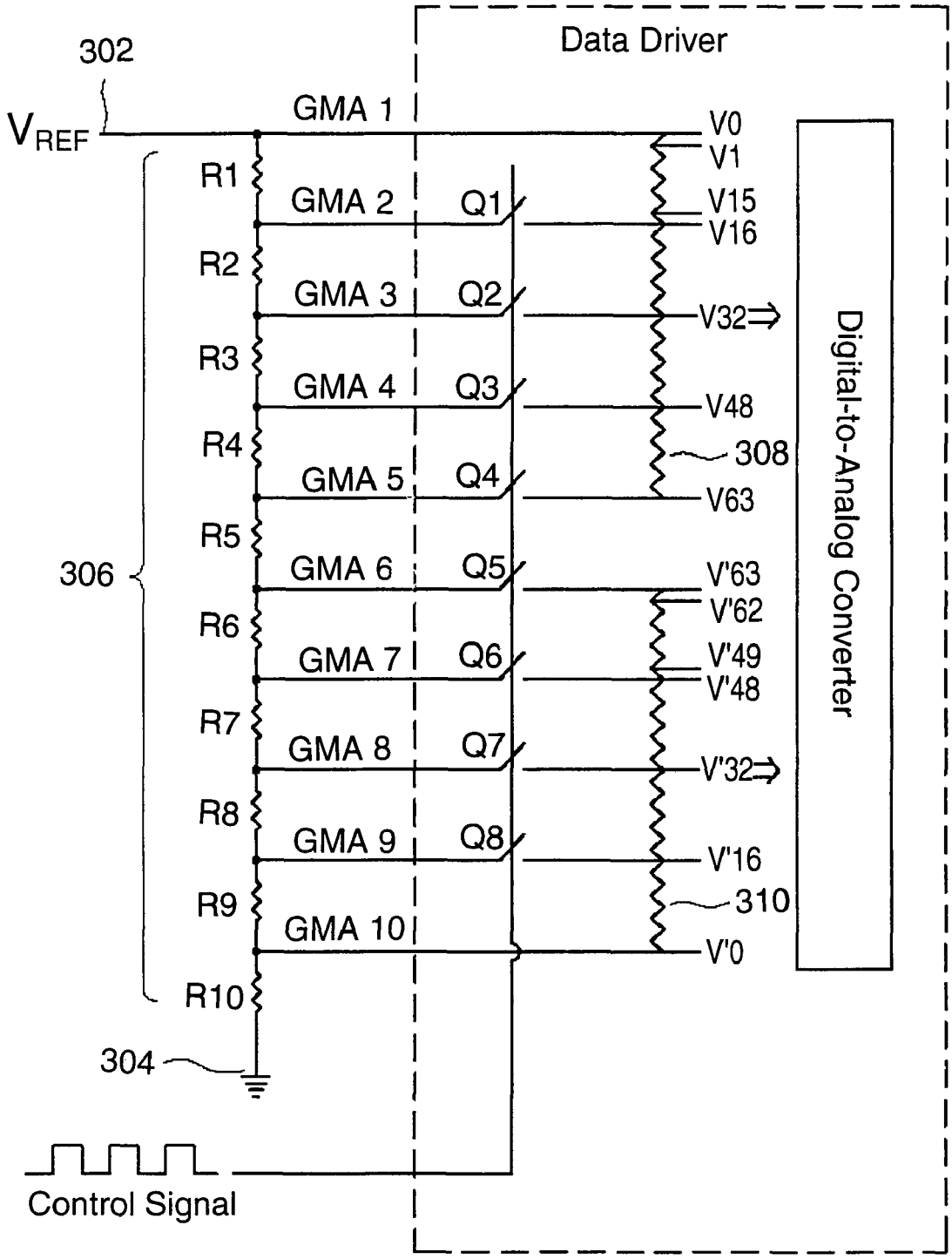
FIG. 3 is a diagram of another gray-scale circuit according to an embodiment.

The gray-scale circuit illustrated in FIG. 3 is also suitable for TN displays, but embodiments are not limited to this application. This gray-scale circuit includes an input node 302, a ground node 304, voltage dividing circuits 306, a plurality of switches such as switches Q1 to Q8, a first series of inner resistors 308, and a second series of inner resistors 310. The term "inner" is not to be considered limiting as it merely refers to one possible orientation. The resistors 308 and 310 could be identified by another term but the term "inner" simplifies the following description.

The voltage dividing circuits 306 may be electrically connected between the input 302 and the ground node 304. The voltage dividing circuits 306 include resistors such as resistors R1 to R10. Thus, if a reference voltage ($V_{REF}$) is input via the input 302 and a ground voltage is input via the ground node 304, the voltage dividing circuits 306 may generate gray-scale reference voltages such as GMA 1 to GMA 10. The voltage dividing circuits 306 may also be electrically connected to switches Q1 to Q8. These switches may be NMOS transistors, PMOS transistors, or any other component that can be used as a switch.

A first grouping of the voltage dividing circuits 306 may be electrically connected to the first series of inner resistors 308, and the inner resistors 308 of the first series are electrically connected to the input 302. A second grouping of the voltage dividing circuits 306 may be electrically connected to the second series of inner resistors 310. The first series of inner resistors 308 and the second series of inner resistors 310 can further divide the gray-scale reference voltages (GMA 1 to GMA 10) into a first set of gray-scale voltages (V0 to V63) and a second set of gray-scale voltages (V'0 to V'63). The first and the second set of gray-scale voltages may be output to a digital-to-analog converter.

Although not shown, the gray-scale circuit of FIG. 3 also includes a timing controller circuit. The timing controller circuit generates a control signal to control the switches Q1 to Q8. That is, the gray-scale circuit uses the control signal to turn the switches Q1 to Q8 on and off. When the switches Q1 to Q8 are turned on, the first and second sets of gray-scale voltages are output to the digital-to-analog converter, whereas when the switches Q1 to Q8 are turn off, fixed voltages, GMA 1 and GMA 10, are output to the digital-to-analog converter. In this way, the display can show normal images or black images.

For example, when the control signal is logic high, the switches Q1 to Q8 are turned on and the voltage dividing circuits 306 divide the inputted reference voltage ($V_{REF}$) to generate gray-scale reference voltages GMA 1 to GMA 10. These reference voltages are further divided by the first series of inner resistors 308 and the second series of inner resistors 310 to enable the gray-scale circuit to output the first set of gray-scale voltages (V0 to V63) and the second set of gray-scale voltages (V'0 to V'63) to the digital-to-analog converter. Therefore, the display can show a plurality of different gray-scale levels—the display shows normal images. When the control signal is logic low however, the switches Q1 to Q8 are turned off and the first series of inner resistors 308 and the second series of inner resistors 310 are floated. Thus, the gray-scale circuit outputs the GMA 1 voltage (V0 to V63) and the GMA 10 voltage (V'0 to V'63) to the digital-to-analog converter to make output buffers (not shown in FIG. 3) of positive polarity in the data driver output GMA 1 voltage and the output buffers (not shown in FIG. 3) of negative polarity in the data driver output GMA 10 voltage. Consequently, the display can show a common gray-scale level, such as a black image.

Figure 4:
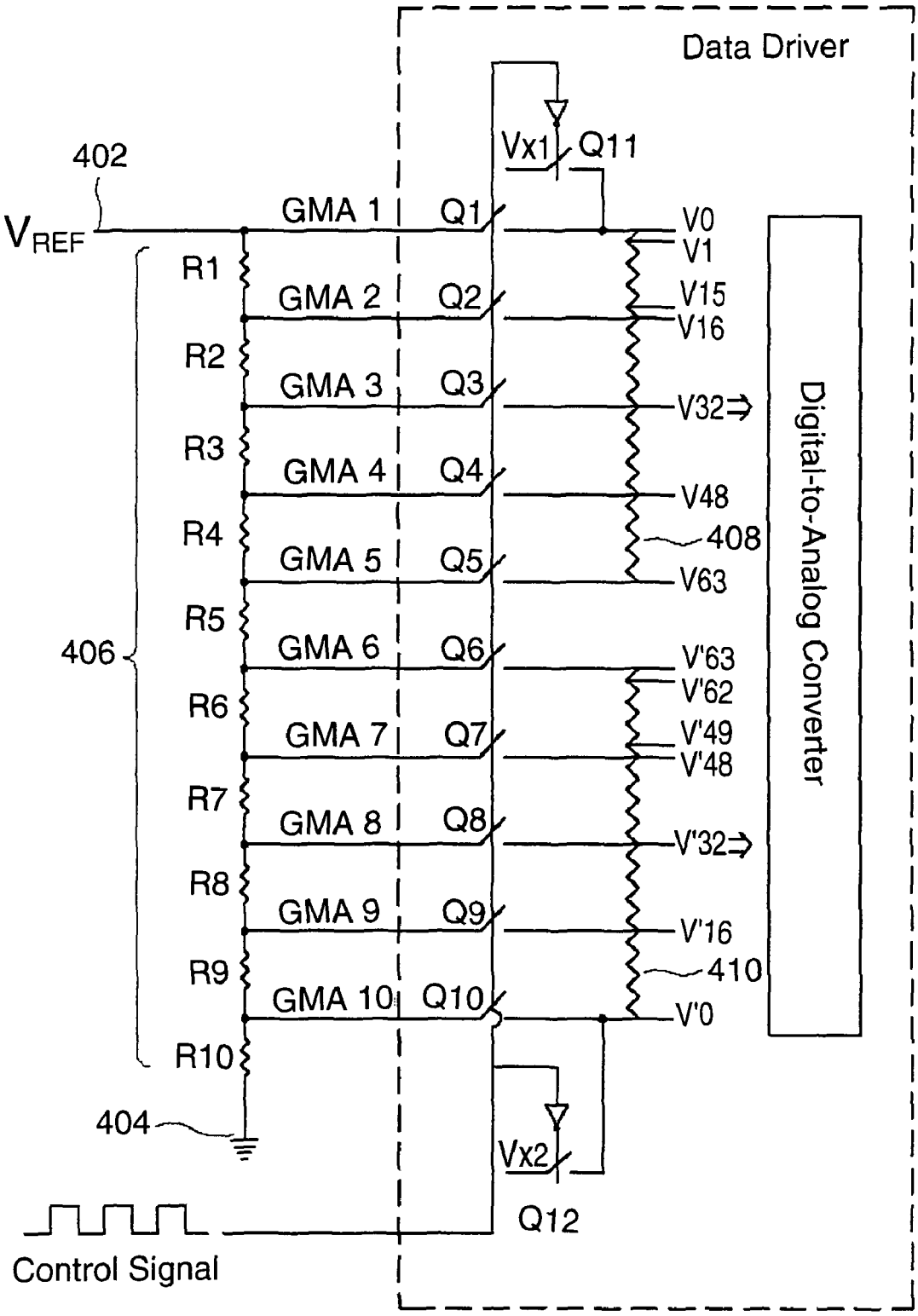
FIG. 4 is another embodiment of a gray-scale circuit.

Referring to FIG. 4, another embodiment of a gray-scale circuit is illustrated. This gray-scale circuit includes an input 402, a ground node 404, voltage dividing circuits 406, a plurality of first switches such as switches Q1 to Q10, a first series of inner resistors 408, a second series of inner resistors 410, a first input $V_{X1}$, a second input $V_{X2}$, a second switch Q11, and a third switch Q12. The switches Q1 to Q10 and the switch Q11 are complementary in phase; the switch Q11 and the switch Q12 are the same in phase. Furthermore, the switches Q1 through Q12 may be NMOS transistors, PMOS transistors, or any other component that can be used as switch.

Generally, a reference voltage ($V_{REF}$) may be input at input 402 and a ground voltage may be input at the ground node 404. The voltage dividing circuits 406, which include resistors such as resistors R1 to R10, are electrically connected between the input 402 and the ground node 404. The voltage dividing circuits 406 may generate gray-scale voltages such as gray-scale reference voltages GMA 1 to GMA 10. Additionally, the voltage dividing circuits 406 may be electrically connected to one end of each switch Q1 to Q10; the switches Q1 to Q10 are also electrically connected to the input 402. The other ends of the switches Q1 to Q5 are electrically connected to the first series of inner resistors 408 and the other ends of the switches Q6 to Q10 are electrically connected to the second series of inner resistors 410. The first series of inner resistors 408 and the second series of inner resistors 410 can further divide the gray-scale reference voltages (e.g. GMA 1 to GMA 10) into a first set of gray-scale voltages (V0 to V63) and a second set of gray-scale voltages (V'0 to V'63), respectively.

The switch Q11 is electrically connected between the switch Q1 and the first series of inner resistors 408, and it is electrically connected to the first input $V_{X1}$. The switch Q12 is electrically connected between the switch Q10 and the second series of inner resistors 410 and it is electrically connected to the second input $V_{X2}$.

The gray-scale circuit shown in FIG. 4 also includes a timing controller circuit (not shown) to generate a control signal to control the switches Q1 to Q10, the switch Q11, and the switch Q12. Thus, the gray-scale circuit can output a plurality of gray-scale voltages or reference voltages at the first input $Vx_1$ and the second input $Vx_2$. That is, the control signal is used by the gray-scale circuit to control the turning on and off of the switches Q1 to Q10, the switch Q11, and the switch Q12 to output a first set of gray-scale voltages and a second set of gray-scale voltages or to output reference voltages at the first input $Vx_1$ and the second input $Vx_2$ respectively, to a digital-to-analog converter to cause the display show normal images or black images.

For example, in vertical alignment (VA) displays, when the control signal is logic high, the switches Q1 to Q10 are turned on, and the switches Q11 and Q12 are turned off. Thus, the voltage dividing circuits 406 divide the inputted reference voltage ($V_{REF}$) to generate gray-scale reference voltages such as GMA 1 to GMA 10. The gray-scale reference voltages are further divided by the first series of inner resistors 408 and the second series of inner resistors 410 so that the gray-scale circuit can output the first set of gray-scale voltages (V0 to V63) and the second set of gray-scale voltages (V'0 to V'63) to the digital-to-analog converter. Therefore, when the control signal is logic high, the display can show a plurality of different gray-scale levels or normal images. When the control signal is logic low however, the switches Q1 to Q10 are turned off, and the switches Q11 and Q12 are turned on. In this instance, the first series of inner resistors 408 and the second series of inner resistors 410 are floated. In some embodiments, the voltage values inputted to the first input $Vx_1$ and the second input $Vx_2$ equal $V_{COM}$; thus, the voltage V0 to V63 and the voltage V'0 to V'63 also equal to $V_{COM}$. The gray-scale circuit outputs the $V_{COM}$ voltage to the digital-to-analog converter such that the output buffers in the data driver output the $V_{COM}$ voltage to make the display show a common gray-scale level, such as a black image.

As another example, in TN displays, when the control signal is logic high, the switches Q1 to Q10 are turned on, and the switches Q11 and Q12 are turned off. Thus, the voltage dividing circuits 406 divide the inputted reference voltage to generate gray-scale reference voltages such as GMA 1 to GMA 10. The gray-scale reference voltages are further divided by the first series of inner resistors 408 and the second series of inner resistors 410 to cause the gray-scale circuit to output the first set of gray-scale voltages (V0 to V63) and the second set of gray-scale voltages (V'0 to V'63) to the digital-to-analog converter. Hence, the display can show a plurality of different gray-scale levels, i.e. the display can show normal images. When the control signal is logic low, the switches Q1 to Q10 are turned off, and the switches Q11 and Q12 are turned on. Thus, the first series of inner resistors 408 and the second series of inner resistors 410 are floated. Because the reference voltage value inputted to the first input $Vx_1$ equals to GMA 1 and the reference voltage value inputted to the second input $Vx_2$ equals to GMA 10, the voltage V0 to V63 equals GMA 1 and the voltage V'0 to V'63 equals GMA 10. Thus, when control signal logic is low, the gray-scale circuit outputs the GMA 1 voltage and the GMA 10 voltage to the digital-to-analog converter to make the output buffers of positive polarity in the data driver all output the GMA 1 voltage and the output buffers of negative polarity in the data driver all output the GMA 10 voltage. Thus, the display can show a common gray-scale level, such as a black image. In other embodiments of the present invention, other values can be inputted into the first input $Vx_1$ and the second input $Vx_2$ according to actual demands to make the display show a common gray-scale level.

Figure 5:
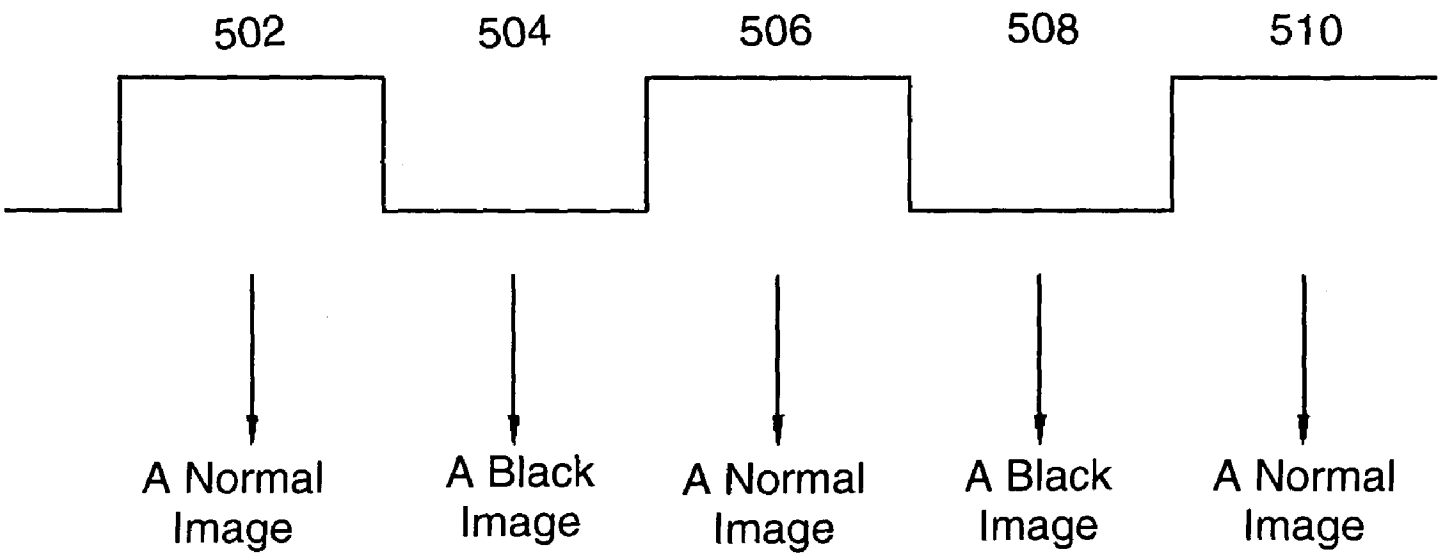
FIG. 5 is a timing diagram of the gray-scale circuit of FIG. 4.

Referring to FIG. 5 a timing diagram of the gray-scale circuit of FIG. 4 is illustrated. When the timing controller circuit outputs the control signal as shown in FIG. 5, the images of a common gray-scale level are inserted. For example, when the control signal is logic high (502, 506, and 510), the switches Q1 to Q10 are turned on, and the switch Q11 and the switch Q12 are turned off, and the gray-scale circuit outputs the first set of gray-scale voltages (V0 to V63) and the second set of gray-scale voltages (V'0 to V'63). Meanwhile, the data driver functions normally, and the display shows normal images. When the control signal is logic low (504 and 508), the switches Q1 to Q10 are turned off, and the switches Q11 and Q12 are turned on, and the gray-scale circuit outputs reference voltage values inputted to the first input $Vx_1$ and the second input $Vx_2$. Meanwhile, an image of a common gray-scale level is shown on the display. The rapid switching of the display period can effectively decrease the blurring and raise the display quality of the displays.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A display apparatus, comprising:

a gray-scale circuit to receive pixel data to generate a first set of gray-scale voltages based on a first set of reference voltages in accordance with the pixel data, and to generate one or more second gray-scale voltages, said one or more second gray-scale voltages based on second, different one or more reference voltages, wherein the gray-scale circuit comprises:

reference voltage circuitry to output the first set of reference voltages, and a plurality of switches that when in a first state cause production of the first set of gray-scale voltages based on the first set of reference voltages, and when in a second state cause production of the second one or more reference voltages; and a liquid crystal panel to receive the first set of gray-scale voltages during a first time period to show a plurality of different gray-scale levels and to receive the one or more second gray-scale voltages during a second time period to show a common gray-scale level.

2. The display apparatus of claim 1, wherein the reference voltage circuitry includes a plurality of voltage dividing circuits electrically connected between a first voltage node and a second voltage node, the voltage dividing circuits to generate the first set of reference voltages;

wherein the plurality of switches each has two ends, one end of each switch electrically connected to a respective voltage dividing circuit;

wherein the gray-scale circuit further comprises:

a first series of inner resistors, electrically connected to a greatest value of the first set of reference voltages, each resistor in said first series of inner resistors electrically connected to a second end of a respective switch in a first subset of said plurality of switches; and a second series of inner resistors, electrically connected to a smallest value of the first set of reference voltages, each inner resistor in said second series electrically connected to a second end of a respective switch in a second subset of said plurality of switches, the first series of inner resistors and the second series of inner resistors to divide the first set of reference voltages into the first set of gray-scale voltages;

wherein the gray-scale circuit is configured to output the first set of gray-scale voltages via the first series of inner resistors and the second series of inner resistors when the switches are turned on during the first time period and the gray-scale circuit is configured to output the second set of gray-scale voltages via the first series of inner resistors and the second series of inner resistors when the switches are turned off during the second time period, the second set of gray-scale voltages being the greatest value and the smallest value of the first set of reference voltages.

3. The display apparatus of claim 1, wherein the second one or more reference voltages comprise multiple second reference voltages, wherein the reference voltage circuitry includes a plurality of voltage dividing circuits, electrically connected between a first voltage node and a second voltage node, the voltage dividing circuits to generate the first set of reference voltages;

wherein the plurality of first switches each has two ends, one end of each first switch electrically connected to a respective voltage dividing circuit;

wherein the gray-scale circuit further comprises:

a first series of inner resistors, each inner resistor in said first series electrically connected to the other end of a respective switch in a first subset of said plurality of first switches;

a second series of inner resistors, each inner resistor in said second series electrically connected to the other end of a respective switch in a second subset of said first plurality of switches, the first series of inner resistors and the second series of inner resistors dividing the first set of reference voltages into the first set of gray-scale voltages;

a second switch electrically connected to the first series of inner resistors, the second switch and the first switches complementary in phase;

a third switch electrically connected to the second series of inner resistors, the third switch and the first switches complementary in phase;

a first input electrically connected to the second switch, the first input to input one of the second reference voltages; and a second input electrically connected to the third switch, the second input to input another of the second reference voltages;

wherein the gray-scale circuit is configured to output the first set of gray-scale voltages during the first time period via the first series of inner resistors and the second series of inner resistors when the first switches are turned on, and is configured to output the one or more second gray-scale voltages during the second time period via the first series of inner resistors and the second series of inner resistors when the first switches are turned off and the second switch and the third switch are turned on.

4. The display apparatus of claim 3, wherein the display apparatus is a vertical alignment display and the second reference voltages inputted to the first input and second input equal a common voltage.

5. The display apparatus of claim 3, wherein the display apparatus is a twisted nematic display, and the second reference voltage inputted to the first input equals a greatest value of the first set of reference voltages and the second reference voltage inputted to the second input equals a smallest value of the first set of reference voltages.

6. The display apparatus of claim 3, wherein the gray-scale circuit further comprises a timing controller circuit to output a control signal to control each of the switches.

7. A display apparatus, comprising:

a gray-scale circuit to receive pixel data to generate a first set of gray-scale voltages based on a first set of reference voltages in accordance with the pixel data, and to generate one or more second gray-scale voltages, said one or more second gray-scale voltages based on second, different one or more reference voltages; and a liquid crystal panel to receive the first set of gray-scale voltages during a first time period to show a plurality of different gray-scale levels and to receive the one or more second gray-scale voltages during a second time period to show a common gray-scale level, wherein the gray-scale circuit further includes:

a first switching circuit having a first switch and a second switch that are complementary in phase, and a first input electrically connected to the second switch to receive the one or more second reference voltages; and a first digital-to-analog converter electrically connected to the first switch, the first digital-to-analog converter to transmit the first set of gray-scale voltages through said first switching circuit when the first switch is turned on during the first time period and when the first switch is turned off and the second switch is turned on during the second time period, the gray-scale circuit to output the one or more second gray-scale voltages.

8. The display apparatus of claim 7, further comprising a selector electrically connected to the first input to choose the one or more second reference voltages from a plurality of reference voltage sources.

9. The display apparatus of claim 7, wherein the second one or more reference voltages comprise multiple second reference voltages, the display apparatus further including:

a second switching circuit having a third switch and a fourth switch that are complementary in phase, a second input electrically connected to the fourth switch to receive another of the second reference voltages, and a second digital-to-analog converter electrically connected to the third switch, the second digital-to-analog converter to transmit a portion of the first set of gray-scale voltages through said second switching circuit when the third switch is turned on during the first time period, and when the third switch is turned off and the fourth switch is turned on during the second time period, said second gray-scale circuit to output a portion of the second gray-scale voltages.

10. The display apparatus of claim 9, further including a multiplexer electrically connected to the first switching circuit and the second switching circuit.

11. The display apparatus of in claim 10, further including a first output buffer and a second output buffer both electrically connected to the multiplexer, the multiplexer to enable the first output buffer and the second output buffer to output the first set of gray-scale voltages during the first time period and to output the second gray-scale voltages during the second time period according to a control signal.

12. The display apparatus of claim 11, wherein, when a polarity signal has a first state, the first output buffer is configured to output a first portion of the first set of gray-scale voltages and the second output buffer is configured to output a second portion of the first set of gray-scale voltages when the control signal is logic high, and the first output buffer is configured to output a first portion of the second gray-scale voltages and the second output buffer is configured to output a second portion of the second gray-scale voltages when the control signal is logic low.

13. The display apparatus as claimed in claim 12, wherein, when the polarity signal has a second state, the first output buffer is configured to output the second portion of the first set of gray-scale voltages and the second output buffer is configured to output the first portion of the first set of gray-scale voltages when the control signal is logic high, and the first output buffer is configured to output the second portion of the second gray-scale voltages and the second output buffer is configured to output the first portion of the second gray-scale voltages when the control signal is logic low.

14. A display apparatus comprising:

a gray-scale circuit comprising:

a first voltage node to input a first reference voltage;

a second voltage node to input a second reference voltage;

a plurality of voltage dividing circuits electrically connected between the first voltage node and the second voltage node, the voltage dividing circuits to generate a plurality of first divided voltages;

a plurality of switches each switch having two ends, one end of each switch electrically connected to a respective part of the voltage dividing circuits;

a first series of inner resistors electrically connected to a greatest value of the first divided voltages and to the other ends of a first group of switches in the plurality of switches, the first series of inner resistors further dividing one part of the first divided voltages into a first set of gray-scale voltages; and a second series of inner resistors electrically connected to a smallest value of the first divided voltages and to the other ends of a second group in the plurality of switches, the second series of inner resistors further dividing another part of the first divided voltages into a second set of gray-scale voltages; and a liquid crystal panel to receive the first set of gray-scale voltages and the second set of gray-scale voltages to show a plurality of different gray-scale levels during a first time period and to receive the greatest value and the smallest value of the first divided voltages to show a common gray-scale level during a second time period.

15. The display apparatus of claim 14, wherein the gray-scale circuit is configured to output the first set of gray-scale voltages and the second set of gray-scale voltages via the first series of inner resistors and the second series of inner resistors when the plurality of switches are turned on during the first time period, and when the plurality of switches are turned off during the second time period, the gray-scale circuit is configured to output the greatest value and the smallest value of the first divided voltages via the first series of inner resistors and the second series of inner resistors.

16. A display apparatus comprising:

a gray-scale circuit comprising:

a first voltage node to input a first reference voltage;

a second voltage node to input a second reference voltage;

two groups of voltage dividing circuits, each voltage dividing circuit in said two groups electrically connected between the first voltage node and the second voltage node, the voltage dividing circuits in said two groups to generate a plurality of divided reference voltages;

two groups of first switches, one end of each first switch in said two groups electrically connected to the first voltage node through a respective voltage dividing circuit, the other ends of the first switches in one of the two groups electrically connected to a first series of inner resistors, the first series of inner resistors to divide the divided voltages from one of the two groups of voltage dividing circuits into a first set of gray-scale voltages, the first switches in the other of the two groups electrically connected to a second series of inner resistors, the second series of inner resistors to divide the divided voltages from the other of the two groups of voltage dividing circuits into a second set of gray-scale voltages;

a second switch electrically connected to the first series of inner resistors, the second switch and the first switches complementary in phase;

a third switch electrically connected to the second series of inner resistors, the third switch and the first switches complementary in phase;

a third voltage node electrically connected to the second switch, the third voltage node to input a third reference voltage; and a fourth voltage node electrically connected to the third switch, the fourth voltage node to input a fourth reference voltage; and a liquid crystal panel to receive the first set of gray-scale voltages and the second set of gray-scale voltages to show a plurality of different gray-scale levels during a first time period and to receive the third reference voltage and the fourth reference voltage to show a common gray-scale level during a second time period.

17. The display apparatus of claim 16, wherein the gray-scale circuit is configured to output the first set of gray-scale voltages and the second set of gray-scale voltages via the first series of inner resistors and the second series of inner resistors when the first switches are turned on and the second switch and the third switch are turned off during the first time period, and the gray-scale circuit is configured to output the third reference voltage and the fourth reference voltage via the first series of inner resistors and the second series of inner resistors when the first switches are turned off, the second switch and the third switch are turned on during the second time period.

18. The display apparatus of claim 17, wherein the display apparatus is a vertical alignment display and the third reference voltage and the fourth reference voltage equal a common voltage.

19. The display apparatus of claim 17, wherein the display apparatus is a twisted nematic display and the third reference voltage equals the greatest value of the first set of gray-scale voltages, and the fourth reference voltage equals the smallest value of the second set of gray-scale voltages.

* * * * *